US006449555B1

(12) United States Patent
Ohba et al.

(10) Patent No.: US 6,449,555 B1
(45) Date of Patent: Sep. 10, 2002

(54) RUN TIME INFORMATION ARITHMETIC OPERATION APPARATUS

(75) Inventors: Yoshikazu Ohba, Fuchu; Hideki Ueno, Funabashi; Masao Kuwahara, Chiba, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/498,367

(22) Filed: Feb. 4, 2000

(30) Foreign Application Priority Data

Mar. 5, 1999 (JP) ..... 11-058752
Mar. 31, 1999 (JP) ..... 11-094208

(51) Int. Cl.[7] ..... G08G 1/123; G08G 1/00; G08G 1/048

(52) U.S. Cl. ..... 701/201; 701/117; 340/928; 340/937

(58) Field of Search ..... 701/201, 117; 340/928, 937, 933; 705/13, 418; 377/20, 49

(56) References Cited

U.S. PATENT DOCUMENTS 3,705,976 A * 12/1972 Platzman ..... 235/61.8 A
3,867,615 A * 2/1975 Sioufi ..... 235/92 TC
4,493,103 A * 1/1985 Yamashita et al. ..... 382/1
4,603,390 A * 7/1986 Mehdipour et al. ..... 364/467
4,774,571 A * 9/1988 Mehdipour et al. ..... 358/108
5,708,425 A * 1/1998 Dwyer et al. ..... 340/928
5,822,712 A * 10/1998 Olsson ..... 701/117
5,926,546 A * 7/1999 Maeda et al. ..... 380/9
5,933,100 A * 8/1999 Golding ..... 340/995
6,073,062 A * 6/2000 Hoshino et al. ..... 701/3
6,078,895 A * 6/2000 Ryu et al. ..... 705/13
6,092,020 A * 7/2000 Fastenrath et al. ..... 701/119
6,098,048 A * 8/2000 Dashefsky et al. ..... 705/10
6,140,941 A * 10/2000 Dwyer et al. ..... 340/928

FOREIGN PATENT DOCUMENTS

JP 11-23588 1/1999
JP 11-39587 2/1999
JP 11-306480 11/1999

* cited by examiner

*Primary Examiner*—Tan Nguyen
*Assistant Examiner*—Dalena Tran
(74) *Attorney, Agent, or Firm*—Oblon, Spivak, McClelland, Maier & Neustadt, P.C.

(57) ABSTRACT

This invention is to provide a travel time information arithmetic operation method and apparatus for calculating travel time information using data obtained by a toll collection system. The travel time information arithmetic operation apparatus includes a travel time arithmetic operation section for calculating a travel time (time required by a vehicle to travel from a given point to another given point) of a vehicle on the basis of data obtained by the toll collection system installed on a tollroad and representing the entry point, entry time, exit point, exit time, and model of the vehicle, and date, a tollgate data storage section for storing the data obtained by the toll collection system and travel time data obtained by the travel time arithmetic operation section, and a travel time information arithmetic operation section for calculating an average travel time value using the travel time n-minutes accumulated data stored in the tollgate data storage section and generating travel time information.

26 Claims, 11 Drawing Sheets

| | |
|---|---|
| 0~5 | 0 |
| 5~10 | 0 |
| 10~15 | 5 |
| 15~20 | 20 |
| 20~25 | 15 |
| 25~30 | 2 |
| 30~35 | 5 |
| 35~40 | 4 |
| 40~45 | 0 |
| 45~50 | 0 |
| 50~55 | 0 |
| 55~60 | 0 |
| 60~65 | 0 |
| 65~70 | 1 |
| 70~75 | 0 |
| 75~80 | 0 |
| 80~85 | 5 |
| 85~90 | 0 |

RUN TIME INFORMATION ARITHMETIC OPERATION APPARATUS

CROSS-REFERENCE TO RELATED APPLICATIONS

This application is based upon and claims the benefit of priority from the prior Japanese Patent Application No. 11-58752, filed Mar. 5, 1999 and No. 11-94208, filed Mar. 31, 1999; the entire contents of which are incorporated herein by reference.

BACKGROUND OF THE INVENTION

The present invention relates to a road traffic control system and, more particularly, to a control system for a tollroad having a toll collection system, and a travel time information arithmetic operation apparatus for calculating information associated with the travel time of a vehicle in a specific object section of a specific object route.

Conventionally, information associated with the travel time (time required by a vehicle to travel from a given point to another given point) of a vehicle is obtained from, e.g., space mean speed information obtained from sensors such as vehicle detectors installed on a road.

In use of vehicle detectors, first, a certain object section of an object route is divided into a plurality of unit sections, and a vehicle detector is installed in each unit section. Using a traveling vehicle speed measured by the vehicle detectors, the travel time of the vehicle in each unit section is calculated. The travel time information of the object section of the object route is obtained by, e.g., totalizing the calculated travel times in the unit sections.

In addition, an AVI system has been put into practical use, in which the license plate number of a traveling vehicle is recognized as an image at the two ends of an object section, thereby measuring the actual travel time of each vehicle that has actually traveled in this object section.

With the above method, however, travel time information cannot be obtained in a route having no sensors. Additionally, sensors of certain type cannot obtain usable travel time information unless a number of sensors are densely installed in the route.

As described above, the conventional scheme is capable of obtaining travel time information only in a route having sensors. To apply this scheme to a route having no sensors, a number of sensors must be installed, resulting in high cost.

BRIEF SUMMARY OF THE INVENTION

It is an object of the present invention to provide a travel time information arithmetic operation method and apparatus for calculating travel time information using data obtained by a toll collection system in a route having no sensors.

According to the present invention, there is provided a travel time information arithmetic operation apparatus comprising a travel time arithmetic operation section which calculates a travel time (time required by a vehicle to travel from a given point to another given point) of a vehicle on the basis of data obtained by a toll collection system installed on a tollroad and representing an entry point, entry time, exit point, exit time, and model of the vehicle, and date, a tollgate data storage section which stores the data obtained by the toll collection system and travel time data obtained by the travel time arithmetic operation section, and a travel time information arithmetic operation section which calculates an average travel time value using the n-minutes accumulated travel time data stored in the tollgate data storage section and generating travel time information.

According to the present invention, the travel time information arithmetic operation section comprises a unusual data removal section which removes, from the accumulated data stored in the tollgate data storage section, unusual data corresponding to data not more than a standard deviation of a travel time data distribution which is defined as a reference, and the travel time average time is calculated using n-minutes accumulated travel time data after unusual data is removed by the unusual data removal section.

According to the present invention, the travel time information arithmetic operation section comprises a necessary data count check section which checks, using data obtained by removing the unusual data by the unusual data removal section, whether data in number necessary for travel time calculation are obtained, a small-number-of-data travel time information arithmetic operation section which calculates travel time information in no traffic jam when the necessary data count check section determines that the data in number necessary for travel time calculation are not present, and a travel time information arithmetic operation section which calculates the average travel time value using the n-minutes accumulated travel time data when the necessary data count check section determines that the data in number necessary for travel time calculation are present.

According to the present invention, the apparatus further comprises an information providing section which provides, to an entry tollgate, travel time information calculated using data collected in units of exit tollgates.

According to the present invention, the apparatus further comprises a tollgate data editing section which rearranges data obtained at exit tollgates in units of entry tollgates, and an information providing section which provides, at the entry tollgate, the travel time information calculated using the data of each entry tollgate, which is obtained by the tollgate data editing section.

According to the present invention, the travel time information arithmetic operation sections are installed in a plurality of continuous routes and obtain a travel time for traveling through the plurality of routes on the basis of travel time information calculated in the respective routes.

According to the present invention, the travel time information arithmetic operation section calculates the travel time information on the basis of data associated with a kind of vehicle using data obtained by deleting data associated with a motorbike.

According to the present invention, there is provided a travel time information arithmetic operation apparatus comprising a travel time arithmetic operation section which calculates a travel time of a predetermined section on the basis of data (data representing the entry tollgate pass time, exit tollgate pass time, model of vehicle, and whether the dates are consecutive) obtained by a toll collection system, a tollgate data storage section which stores the data obtained by the toll collection system and travel time data obtained by the travel time arithmetic operation section, a frequency analysis section which analyzes a frequency of n-minutes accumulated data stored in the tollgate data storage section, a long stopping vehicle data removal section which removes long stopping vehicle data from a result of frequency analysis by the frequency analysis section, an Otsu threshold value arithmetic operation section which using the Otsu threshold method, calculates a threshold value used to divide, into a plurality of divisions, the n-minutes accumulated data after the long stopping vehicle data is removed by the long stopping vehicle data removal section, a cluster analysis section which divides the n-minutes accumulated data into a plurality of data using the threshold value calculated by the Otsu threshold value arithmetic operation section, a unusual data removal section which removes unusual data on the basis of a result from the cluster analysis section, and a travel time information output section which calculates an average value of the travel time on the basis of the n-minutes accumulated data after the unusual data is removed by the unusual data removal section and generating travel time information.

According to the present invention, there is provided a travel time information arithmetic operation apparatus comprising: a travel time arithmetic operation section which calculates, in a tollroad having a toll collection system capable of acquiring data representing an entry point, entry time, or exit time, a travel time required by a vehicle to travel a predetermined section on the basis of data associated with an entry tollgate pass time, exit tollgate pass time, kind of vehicle, and date, which is obtained by the toll collection system; a tollgate data storage section which stores the data obtained by the toll collection system and travel time data obtained by the travel time arithmetic operation section; a first data count check section which checks whether n-minutes accumulated data stored in the tollgate data storage section has reached a necessary data count; a moving average arithmetic operation section which obtains travel time information using a moving average as one travel time information arithmetic operation method when the number of data is small; a free flow travel time information arithmetic operation section which obtains travel time information using a travel time in no traffic jam as one travel time information arithmetic operation method when the number of data is small; an another-section-data-using travel time information arithmetic operation section which obtains travel time information by subtracting data of another section from that of a self-section as one travel time information arithmetic operation method when the number of data is small; a case determination section which when the first data count check section determines that data count does not satisfy the necessary data count, i.e., when the number of data is small, determines, as a travel time information arithmetic operation section to be used, one of the moving average arithmetic operation section, the free flow time information arithmetic operation section, and the another-section-data-using travel time information arithmetic operation section; a frequency analysis section which when the first data count check section determines that the data count is satisfied, analyzes a frequency of the n-minutes accumulated data stored in the tollgate data storage section; a long stopping vehicle data removal section which removes long stopping vehicle data from a result of frequency analysis by the frequency analysis section, a second data count check section which checks the data count after the long stopping vehicle data is removed; an otsu threshold value arithmetic operation section which when the second data count check section determines that the data count satisfies the necessary data count, uses the Otsu threshold method, calculates a threshold value used to divide, into two divisions, the n-minutes accumulated data after the long stopping vehicle data is removed by the long stopping vehicle data removal section; a cluster analysis section which divides the n-minutes accumulated data into two divisions using the threshold value calculated by the Otsu threshold value arithmetic operation section; a unusual data removal section which removes unusual data on the basis of a result from the cluster analysis section; a travel time information arithmetic operation section which calculates an average travel time value as travel time information using the n-minutes accumulated data after the unusual data is removed by the unusual data removal section; and a travel time information providing section which provides the travel time information calculated by the travel time information arithmetic operation section.

Additional objects and advantages of the present invention will be set forth in the description which follows, and in part will be obvious from the description, or may be learned by practice of the present invention. The objects and advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrated presently preferred embodiments of the present invention and, together with the general description given above and the detailed description of the preferred embodiments given below, serve to explain the principles of the present invention.

DETAILED DESCRIPTION OF THE INVENTION

An apparatus according to the first embodiment of the present invention will be described below with reference to the accompanying drawing.

Figure 1:
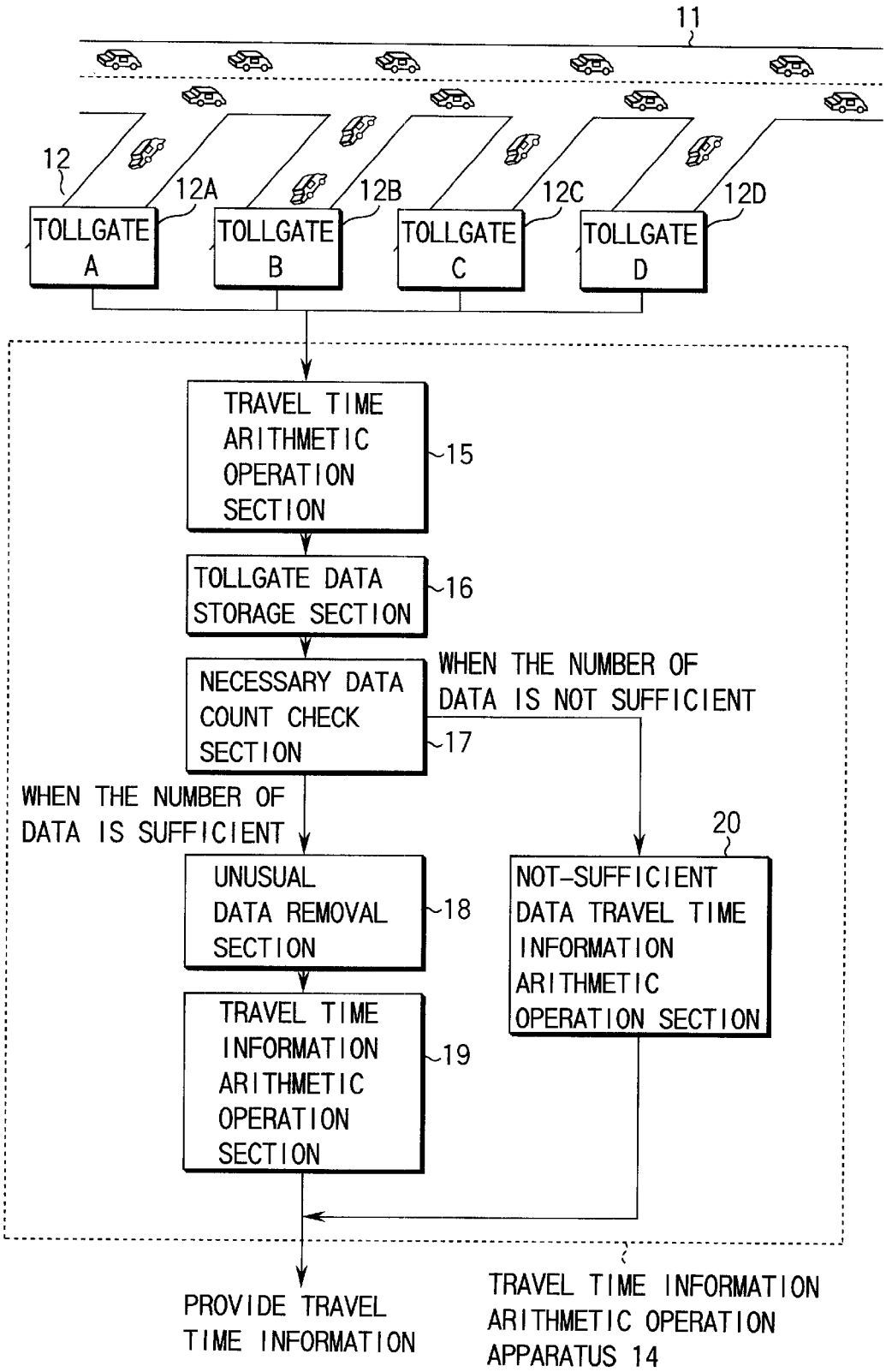
FIG. 1 is a view showing a toll collection system including a travel time information arithmetic operation apparatus according to the first embodiment of the present invention.

According to the system arrangement of a travel time information arithmetic operation apparatus shown in FIG. 1, a toll collection system is installed in a route of an object tollroad. More specifically, a tollroad 11 has a plurality of tollgates 12 (12A to 12D). Each tollgate has an electronic apparatus (not shown) including a computer and the like and having a function of issuing a pass that records data representing the entry point, entry time, exit point, and exit time of a vehicle 13, kind of vehicle, and date, and reading the data recorded on the pass. This electronic apparatus is connected to a travel time information arithmetic operation apparatus 14. The travel time information arithmetic operation apparatus 14 comprises a travel time arithmetic operation section 15, tollgate data storage section 16, necessary data count check section 17, unusual data removal section 18, travel time information arithmetic operation section 19, and small-number-of-data travel time information arithmetic operation section 20.

The travel time arithmetic operation section 15 calculates the travel time on the basis of data read from the pass, i.e., tollgate data representing the entry tollgate pass time, exit tollgate pass time, kind of vehicle, and whether the dates are consecutive. The tollgate data storage section 16 has, e.g., a file which stores the tollgate data obtained from each tollgate 2 and the travel time calculated by the travel time arithmetic operation section 15. The necessary data count check section 17 confirms whether data in number necessary for travel time calculation are stored in the tollgate data storage section 16. This necessary number of data is the number of data obtained in, e.g., five minutes and for example, about 10 to 12. This number of data is determined on the basis of empirical statistics.

The unusual data removal section 18 removes unusual data for calculation of travel time information. The travel time information arithmetic operation section 19 calculates the average value of travel time data obtained in n minutes. The small-number-of-data travel time information arithmetic operation section 20 calculates travel time information when the number of data is small.

The function of the toll collection system having the above arrangement will be described with reference to the flow chart shown in FIG. 2.

First, in the tollgate 12 installed at the exit of the tollroad 11, tollgate data representing the entry tollgate pass time, exit tollgate pass time, kind of vehicle, and whether the dates are consecutive is read out from the pass (step S11). This tollgate data is transferred to the travel time arithmetic operation section 15. The travel time arithmetic operation section 15 calculates the travel time on the basis of the transferred tollgate data (step S12). The travel time can be obtained from the entry tollgate pass time and exit tollgate pass time on the basis of the following equation.

$$\text{Travel time} = \text{exit tollgate pass time} - \text{entry tollgate pass time}$$

If the date changes between the entry pass time and the exit pass time of the vehicle, i.e., the dates are consecutive, the travel time is calculated in consideration of the change in date.

The travel time calculated by the travel time arithmetic operation section 15 and the tollgate data obtained from the tollgate 12 are stored as a file or the like in the tollgate data storage section 16 (step S13). At this time, the necessary data count check section 17 checks whether data in number necessary (e.g., x) for calculation of the travel time information are stored in the tollgate data storage section 16 (step S14). If data in number necessary for travel time calculation are stored, the unusual data removal section 18 removes unusual data (step S15). For removal of unusual data, the standard deviation (or variance) of data is taken into consideration, and unusual data are removed until the standard deviation is a certain value (e.g., y) or less. To remove unusual data, the following methods can be used.

(1) For the travel time, data with the longest travel time is regarded as unusual data and removed. After this removal, the standard deviation is calculated, and it is checked whether the condition is satisfied. If the condition is satisfied, removal of unusual data is ended. If the condition is not satisfied, the next longest data is removed, the standard deviation is calculated, and it is checked whether the condition is satisfied. This operation is repeated until the standard deviation satisfies the condition.

(2) In the method (1), not only the longest data but also the shortest data is simultaneously removed as unusual data. For example, since a motorbike is not largely influenced by traffic jam, data associated with this motorbike corresponds to the shortest data and can be removed as unusual data.

(3) In the method (1), not the longest data but data out of the range of ±Q% of the highest frequency is removed as unusual data.

Using data after unusual data are removed by the travel time arithmetic operation section 15, the travel time information arithmetic operation section 19 calculates the average value of travel time data obtained in n minutes (e.g., five minutes) (step S16). This average travel time value is issued as travel time information (step S17).

In determination of the necessary number of data in step S14, if it is determined that data in number necessary for travel time calculation are not stored, the small-number-of-data travel time information arithmetic operation section 20 calculates travel time information when the number of data is small (step S18). To calculate the travel time information when the number of data is small, the following methods can be used.

(1) The distance from the entry tollgate to the exit tollgate is divided by the traveling speed without jam, thereby obtaining the travel time.

(2) The travel time measured by actual traveling is used.

When the number of data is small, information obtained by the method (1) or (2) is issued as travel time information (step S17).

As described above, according to the travel time information arithmetic operation apparatus of this embodiment, unusual data are deleted from the tollgate data, and then, the travel time information is calculated. Since this operation removes the influence of vehicles which are stopping for a long time in a service area or a rest area and vehicles traveling in a manner different from the general traveling method, travel time information having a high value in use can be calculated. This can also cope with a case wherein the number of data is small. For this reason, degradation in accuracy due to the small number of data can be avoided.

Figure 2:
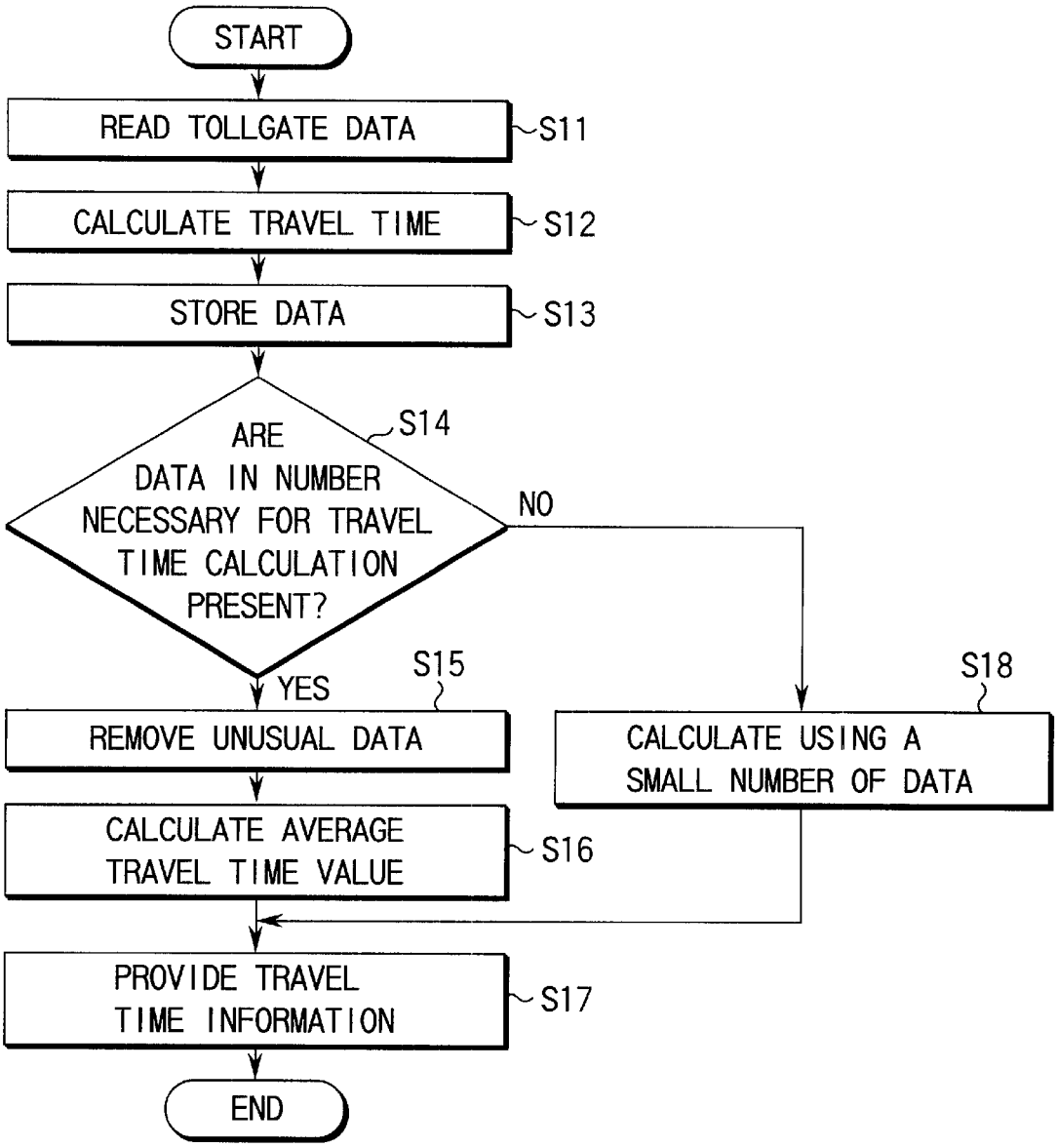
FIG. 2 is a flow chart for explaining the operation of the travel time information arithmetic operation apparatus shown in FIG. 1.
Figure 3:
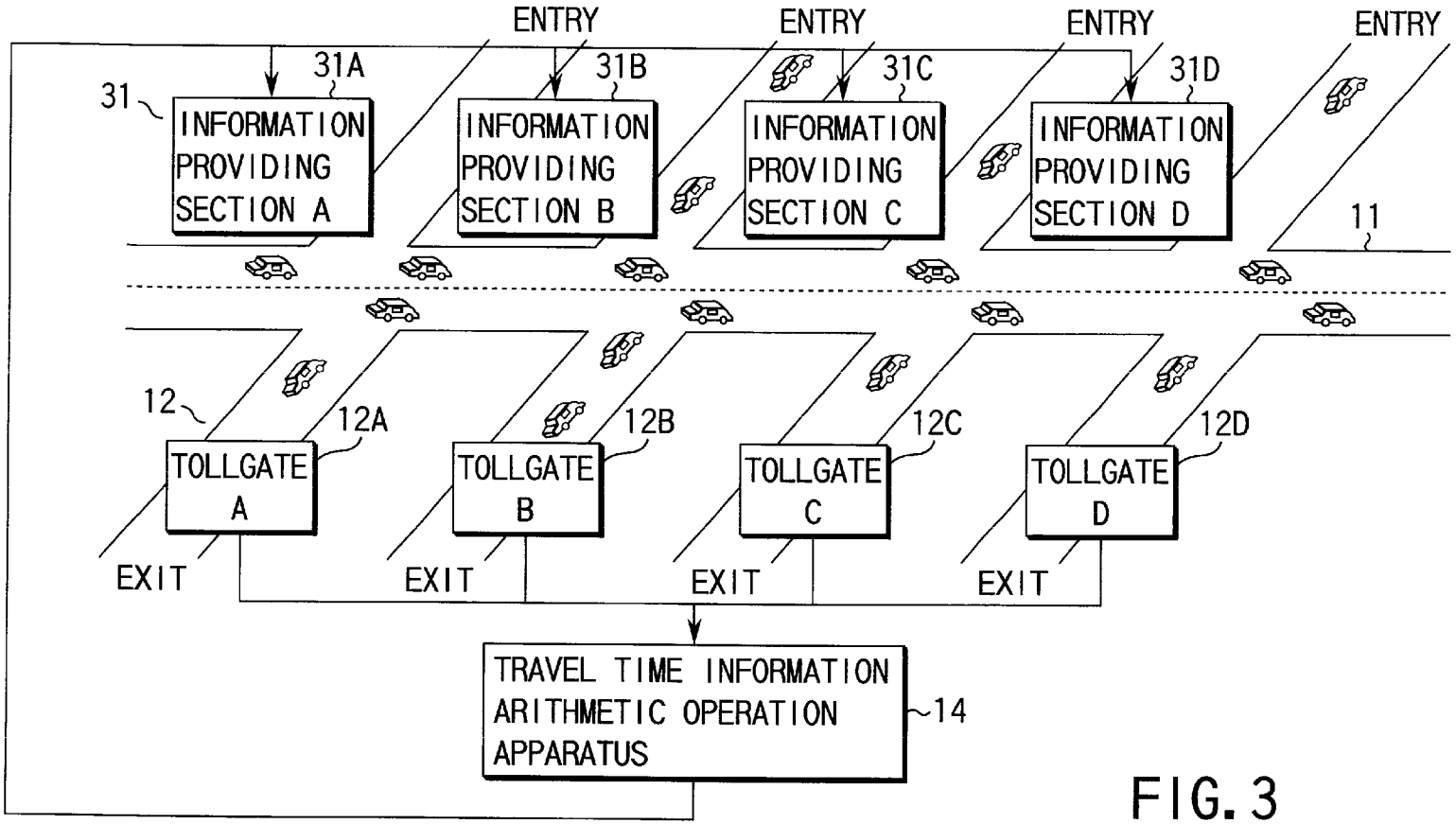
FIG. 3 is a view showing a toll collection system according to the second embodiment of the present invention, which has an information providing section in addition to the travel time information arithmetic operation apparatus of the present invention.

FIG. 2 shows the system arrangement of a travel time information arithmetic operation apparatus according to the second embodiment. According to this arrangement, an object route has a toll collection system, and the same travel time information arithmetic operation apparatus as in the first embodiment is installed. In the second embodiment, information providing sections 31 (31A to 31D) are provided at entry tollgates, respectively, in addition to the arrangement of the first embodiment.

According to the second embodiment, first, using tollgate data obtained from exit tollgates, which are obtained from tollgates 2, a travel time information arithmetic unit 14 calculates travel time information. Next, using the calculated travel time information, the information providing sections 31 installed at the entry tollgates provide the travel time information. Immediately after the travel time information is calculated by the travel time-information arithmetic operation apparatus 14, the travel time information is provided by displaying or printing it by the information providing sections 31 at the entry tollgates.

According to the travel time information arithmetic operation apparatus of the second embodiment, in addition to the effect of the travel time information arithmetic operation apparatus 14 of the first embodiment, the latest information can be provided to the entry tollgate as travel time information.

Figure 4:
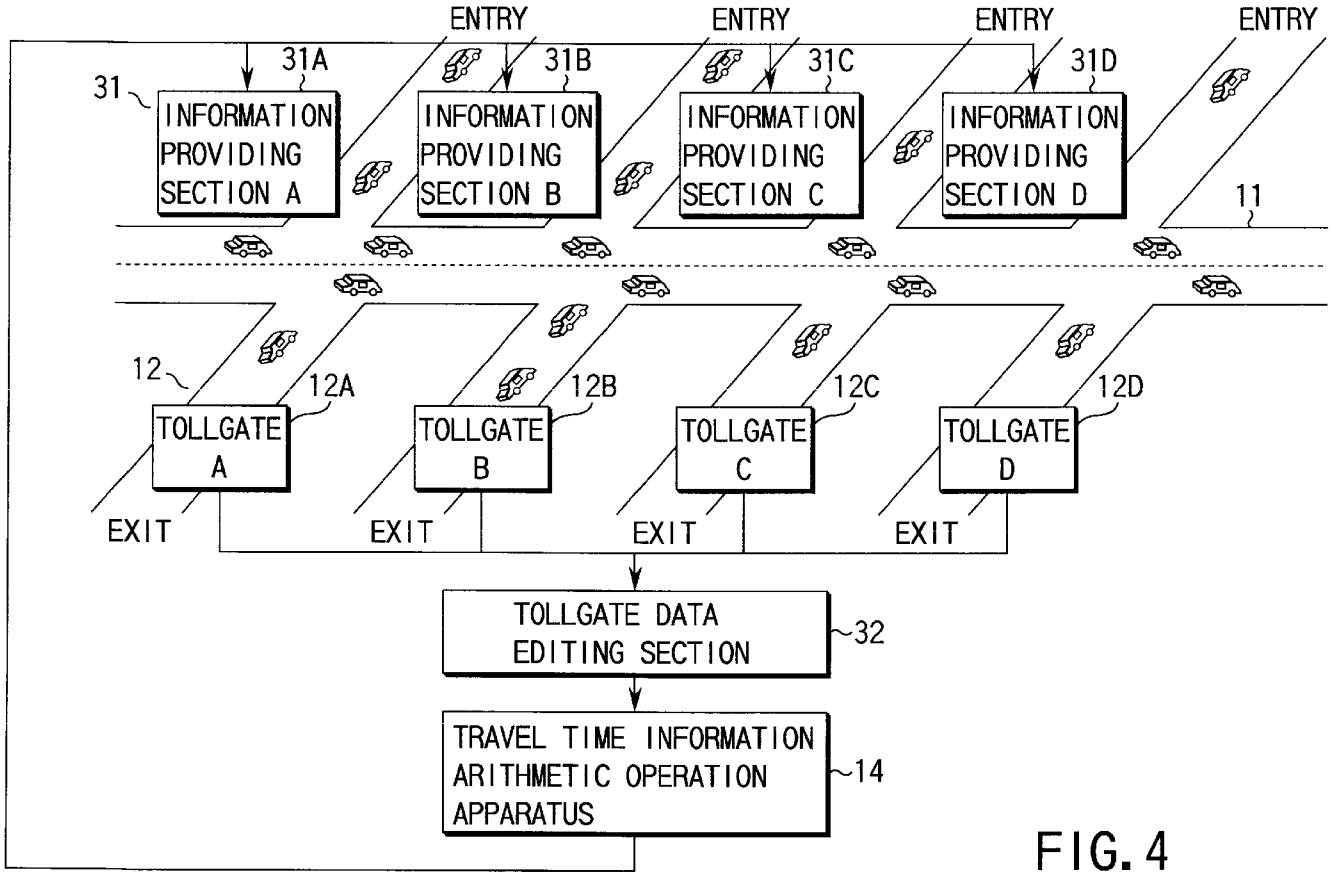
FIG. 4 is a view showing a toll collection system according to the third embodiment of the present invention, which has an information providing section and tollgate data editing section in addition to the travel time information arithmetic operation apparatus of the present invention.

FIG. 4 shows the system arrangement of a travel time information arithmetic operation apparatus according to the third embodiment. According to this arrangement, an object route has a toll collection system, and the same travel time information arithmetic operation apparatus 14 as in the first embodiment is installed. In the third embodiment, information providing sections 31 and tollgate data editing section 32 are provided in addition to the arrangement of the first embodiment.

According to the third embodiment, first, tollgate data from exit tollgates, which are obtained from exit tollgates 12, are rearranged to data for the entry tollgates by the tollgate data editing section 32. Using the tollgate data obtained by rearranging the exit toll data to data for each entry tollgate, a travel time information arithmetic operation apparatus 14 calculates travel time information. Next, using the calculated travel time information, the information providing sections 31 installed at the entry tollgates provide the travel time information. Immediately after the travel time information is calculated by the travel time information arithmetic operation apparatus 14, the travel time information is provided by the information providing sections 31 at the entry tollgates.

According to the travel time information arithmetic operation apparatus of the third embodiment, in addition to the effect of the travel time information arithmetic operation apparatus of the first embodiment, data obtained by rearranging the tollgate data to data for each entry tollgate is used to enable data use along with the elapse of time at the entry tollgate. Hence, travel time information according to the change over time at the entry tollgate can be provided.

Figure 5:
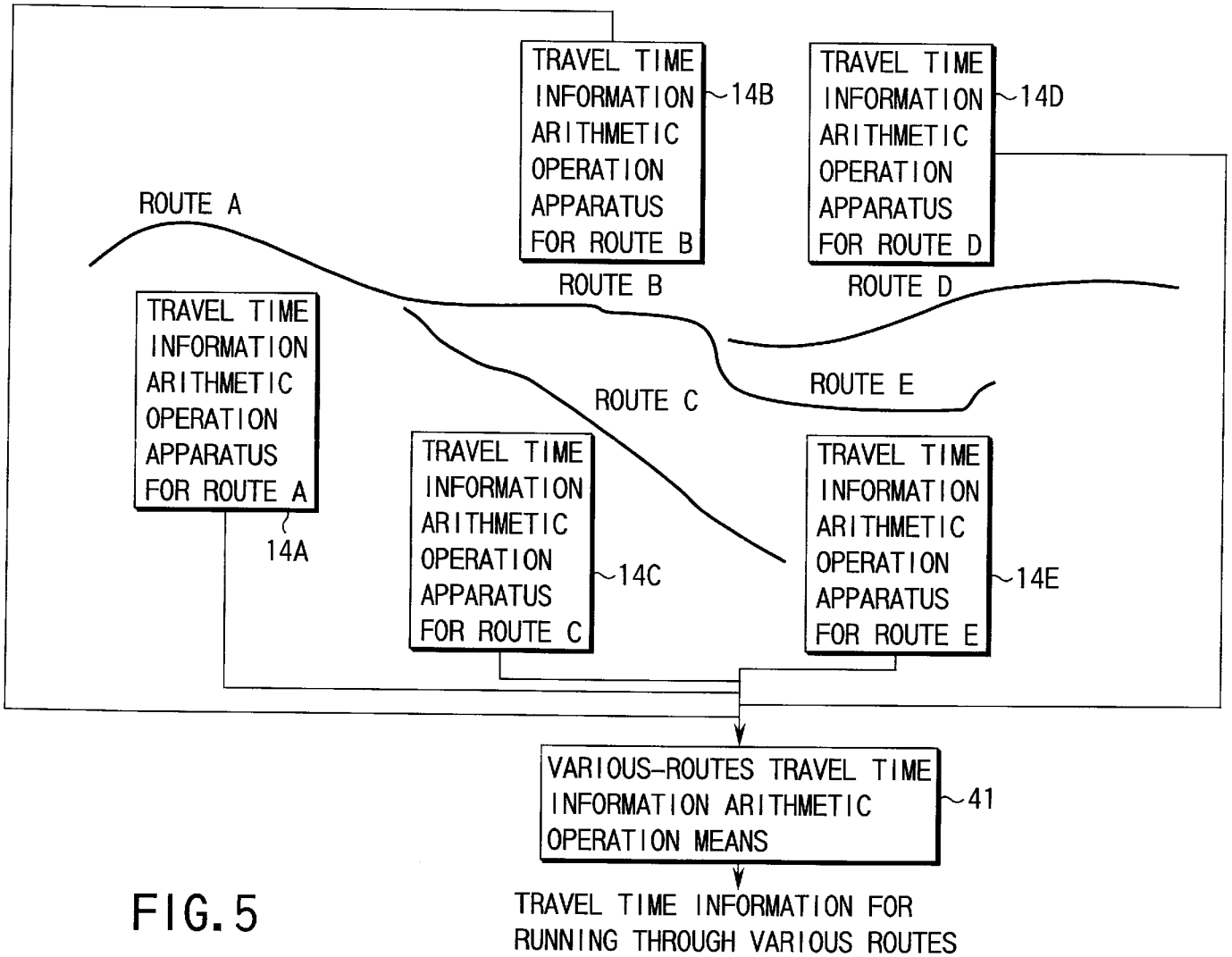
FIG. 5 is a view showing a toll collection system according to the fourth embodiment of the present invention, in which travel time information arithmetic operation apparatuses of the present invention are provided in a plurality of routes, respectively.

FIG. 5 shows the system arrangement of a travel time information arithmetic operation apparatus according to the fourth embodiment. According to this arrangement, object routes A to E have toll collection systems, respectively, and the same travel time information arithmetic operation apparatuses 14 (14A to 14E) as in the first embodiment are installed in the routes, respectively. In the fourth embodiment, a plurality-of-route travel time information arithmetic operation apparatus 41 is provided in addition to the arrangement of the first embodiment.

According to the fourth embodiment, the travel time information arithmetic operation apparatuses 14 installed in the plurality of routes A to E, respectively, calculate pieces of travel time information (in this case, the average values of travel times) of the corresponding routes, respectively. Next, using the pieces of travel time information of the routes, the travel time information arithmetic operation apparatus 41 calculates travel time information of the plurality of routes A to E. In this case, as the simplest method, a method of simply totalizing the travel times of the passed routes is employed.

According to the travel time information arithmetic operation apparatus of the fourth embodiment, in addition to the effect of the travel time information arithmetic operation apparatus of the first embodiment, travel time information for traveling through a plurality of routes can be calculated.

In the first embodiment, unusual data is removed taking standard deviation into consideration. However, for example, a rule for deleting data that is obviously found as unusual data can be created and used to remove data. Various methods can be used to remove unusual data, though the method must be selected in consideration of the processing ability of hardware or calculation accuracy from the obtained data.

In the above embodiments, the number of data changes depending on whether data are received at the entry or exit. Generally, the number of data received at the entry at a predetermined interval is relatively small, and the number of data is large at the exit. Hence, to calculate accurate travel time information, the number of data at the exit is preferably employed.

Figure 6:
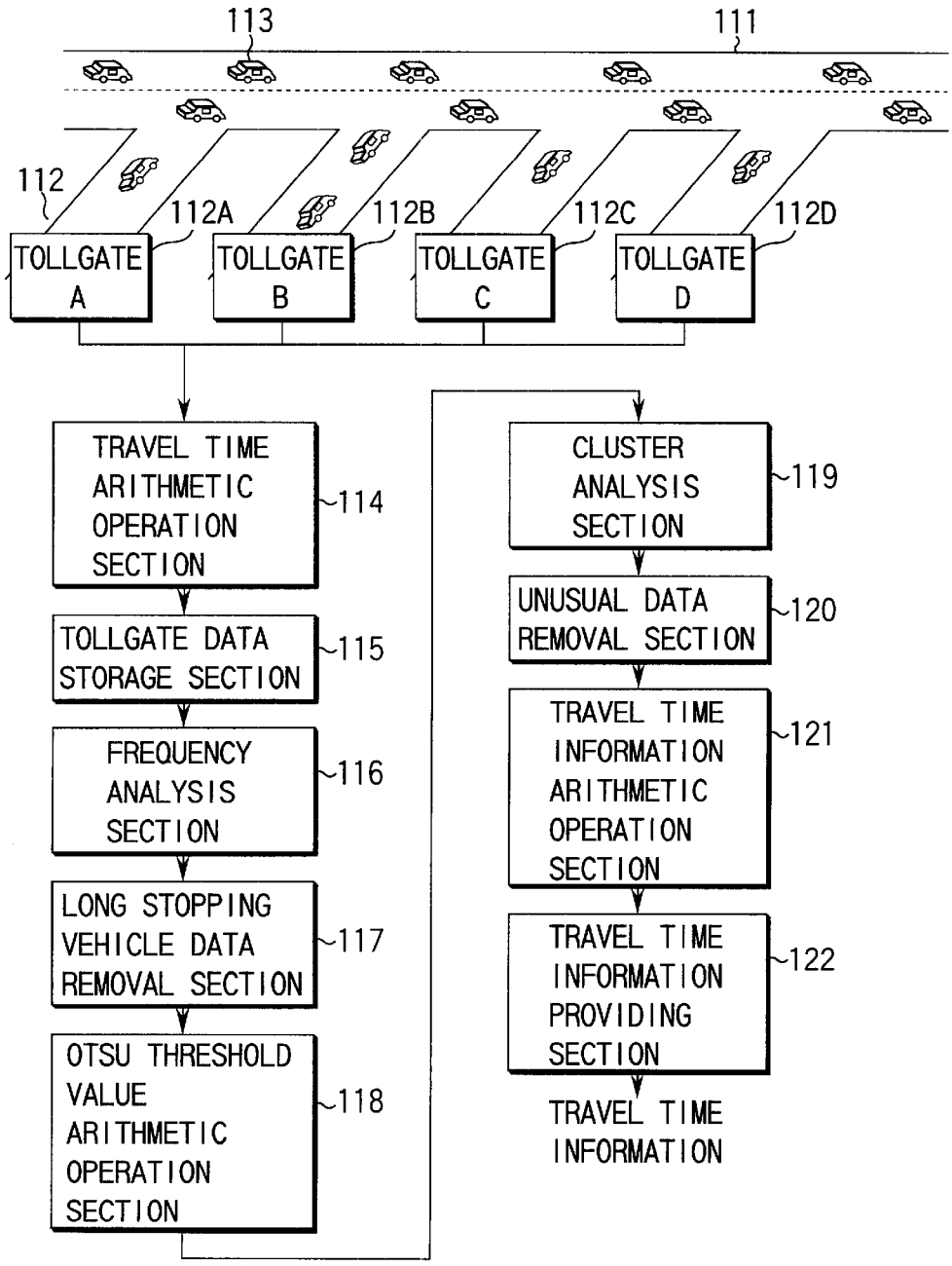
FIG. 6 is a block diagram of a travel time information arithmetic operation apparatus according to the fifth embodiment of the present invention.

An apparatus according to the fifth embodiment of the present invention will be described below with reference to the accompanying drawing. According to the system arrangement of the travel time information arithmetic operation apparatus shown in FIG. 6, assume that a toll collection system is installed in a route of an object tollroad. More specifically, a tollroad 111 has a plurality of tollgates 112 (112A to 112D). Each tollgate has a toll collection system (not shown) including a computer and the like and having a function of issuing a pass that records data representing the entry point, entry time, exit point, and exit time of a vehicle 113, kind of vehicle, and date, and reading the data recorded on the pass. This toll collection system comprises a travel time arithmetic operation section 114, tollgate data storage section 115, frequency analysis section 116, long stopping vehicle data removal section 117, Otsu threshold value arithmetic operation section 118, cluster analysis section 119, unusual data removal section 120, travel time information arithmetic operation section 121, and travel time information influencing section 122.

The travel time arithmetic operation section 114 calculates the travel time (time required by a vehicle to travel from a given point to another given point) on the basis of data obtained from the toll collection system (entry tollgate pass time, exit tollgate pass time, kind of vehicle, and whether the dates are consecutive. Basically, the travel time is calculated using the entry tollgate pass time and exit tollgate pass time.

The data obtained from the toll collection systems and travel time data obtained by the travel time arithmetic operation section 114 are stored in the tollgate data storage section 115. Using the data stored in the tollgate data storage section, the frequency analysis section 116 analyzes the frequency of data stored in n minutes. This frequency analysis is executed by dividing the travel time of data stored for n minutes into levels of m minutes and counting the frequency.

The long stopping vehicle data removal section 117 removes long stopping vehicle data from the result of frequency analysis by the frequency analysis section 116. As the simplest method, when travel time level of frequency "0" continues for several levels on the basis of the result of frequency analysis, data for the frequency "0" that continues for several levels is regarded as long stopping vehicle data (however, the travel time level is set in ascending order of travel time). At this time point, it is regarded that data of a vehicle that has stopped for a long time in a service area or a rest area or data of a vehicle that has stopped for a long time due to trouble is removed.

Next, a threshold value used to divide, into two divisions, n-minutes accumulated data after the long stopping vehicle data removal section 117 has removed the long stopping vehicle data is calculated by the Otsu threshold method. The Otsu threshold method is an algorithm for setting a threshold value used for image processing and an automatic threshold value selection method using a criterion with the maximum degree of class separation. As the characteristic feature of this method, the threshold value can always be obtained.

The method of obtaining a threshold value by the Otsu threshold method using travel time data will be briefly described below. Table 1 shows object data. In this case, the threshold value by the Otsu threshold method is obtained by the following STEP1 to STEP3.

TABLE 1

| | Run time data used for description of Otsu threshold method | | |
|---|---|---|---|
| Level Number | Run time level [min] | Median of travel time corresponding to level number: T1 | Frequency |
| 1 | 0 to 5 | 2.5 | C(1) |
| 2 | 5 to 10 | 7.5 | C(2) |
| 3 | 10 to 15 | 12.5 | C(3) |
| . | . | . | . |
| . | . | . | . |
| . | . | . | . |
| k | to k × 5 | k × 5 − 2.5 | C(k) |

STEP1: Calculation of Total Average and Total Variance

A total average $\mu T$ and total variance $\sigma T^2$ are given by:

$$\mu T = \sum_{m=1}^{k} (TI(m) \times P(m))$$

$$\sigma T^2 = \sum_{m=1}^{k} ((TI(m) - \mu T)^2 \times P(m))$$

$$\left( P(i) = \frac{C(i)}{\sum_{m=1}^{k} C(m)} \right)$$

P(i): ratio of data of level i to the total number of data

STEP2: Calculation of Interclass Variance

The interclass variance $\sigma c^2$ from level 1 to level k is obtained by the following equation (the following equation is used to obtain the interclass variance of level i).

$$\sigma_c^2 = \frac{(\mu T \times w(i) - u(i))^2}{w(i)(1 - w(i))}$$

$$\left( w(i) = \sum_{m=1}^{i} P(m) \qquad u(i) = \sum_{m=1}^{i} (P(m) \times TI(m)) \right)$$

STEP3: Selection of Optimum Threshold Value

The maximum level of interclass variance calculated in STEP2 is selected as the optimum threshold value.

On the basis of the threshold value calculated by the Otsu threshold value arithmetic operation section 118, the data of n-minute travel time is divided into two sets by the cluster analysis section 119. In this case, the travel time data is divided into data larger than the threshold value and data smaller than the threshold value on the basis of the threshold value obtained by the Otsu threshold method.

Next, on the basis of the result from the cluster analysis section 119, the unusual data removal section 120 removes unusual data. As the unusual data removal rule, the following rules can be used.

(I) Data in a smaller number are regarded as unusual data and removed.

(II) Data with longer travel times are regarded as unusual data and removed.

At this time point, it is regarded that data that falls out of the travel time of average driving by an average driver (travel time data of a driver who likes to drive at a high speed or low speed) is removed.

Using the n-minutes accumulated data after removal of unusual data by the unusual data removal section 120, the travel time information arithmetic operation section 121 calculates the average travel time value as travel time information.

Finally, the travel time information calculated by the travel time information arithmetic operation section 121 is provided by the travel time information providing section 122.

Figure 7:
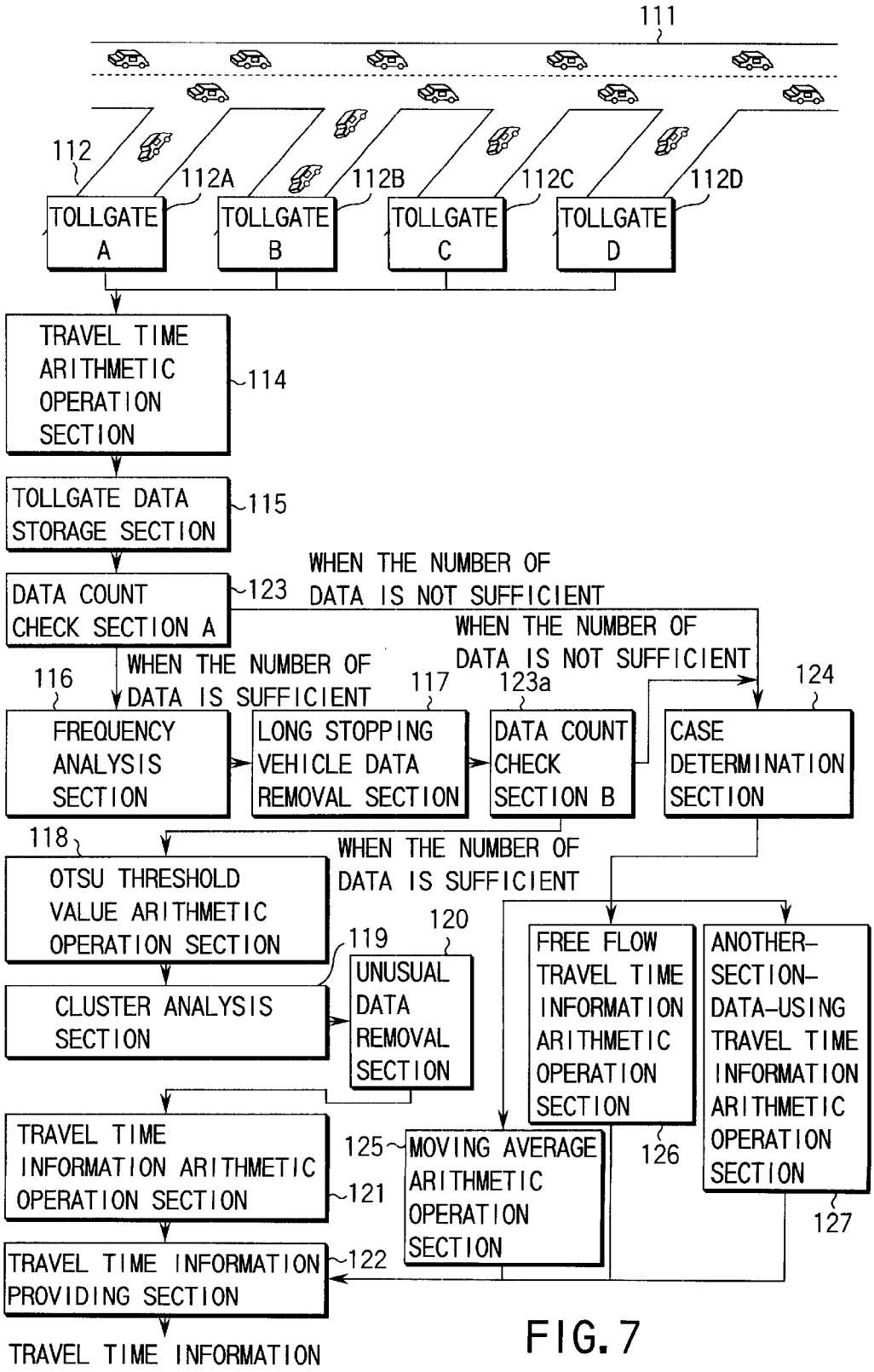
FIG. 7 is a block diagram of a travel time information arithmetic operation apparatus according to the sixth embodiment of the present invention.

The sixth embodiment will be described next with reference to FIG. 7. In this embodiment, the same processing as in the fifth embodiment is performed by a travel time arithmetic operation section 114 to a travel time information providing section 122. However, the following processing is added.

A data count check section (A) 123 checks whether n-minutes accumulated data stored in a tollgate data storage section 115 satisfies the necessary number of data. If the number of data does not satisfy the necessary number of data, a case determination section 124 determines, as the arithmetic operation section to be used when the number of data is small, one of a moving average arithmetic operation section 125, free-flow-time-information arithmetic operation section 126, and another-section-data-using-travel time information arithmetic operation section 127.

When the case determination section 124 selects the moving average arithmetic operation section 125, a moving average is obtained as travel time information. When the case determination section 124 selects the free-flow-travel time-information arithmetic operation section 126, the travel time-information arithmetic operation section 126 obtains a travel time when no traffic jam occurs as travel time information. When the case determination section 124 selects the another-section-data-using-travel time information arithmetic operation section 127, the another-section-data-using-travel time information arithmetic operation section 127 obtains travel time information by subtracting data of another section.

When the data count check section (A) 123 determines that the number of data satisfies the necessary data count, the frequency analysis section 116 analyzes the frequency of n-minutes accumulated data stored in the tollgate data storage section 115. Using the result, the long-stopping-vehicle data removal section 117 removes long-stopping-vehicle data.

After the long-stopping-vehicle data removal section 117 removes long-stopping-vehicle data, a data count check section (B) 123*a* checks whether the necessary number of data is satisfied.

When the data count check section (B) 123*a* determines that the number of data satisfies the necessary data count, the Otsu threshold value arithmetic operation section 118, cluster analysis section 119, and unusual data removal section 120 remove unusual data. After that, using the n-minutes accumulated data after removal of unusual data, the travel time-information arithmetic operation section 121 calculates the average travel time value as travel time information.

Finally, the travel time information calculated by the travel time-information arithmetic operation section 121, travel time information calculated by the moving average arithmetic operation section 125, travel time information calculated by the free-flow-travel time information arithmetic operation section 126, or travel time information calculated by the another-section-data-using-travel time information arithmetic operation section 127 is provided by the travel time information providing section 122.

Figure 8:
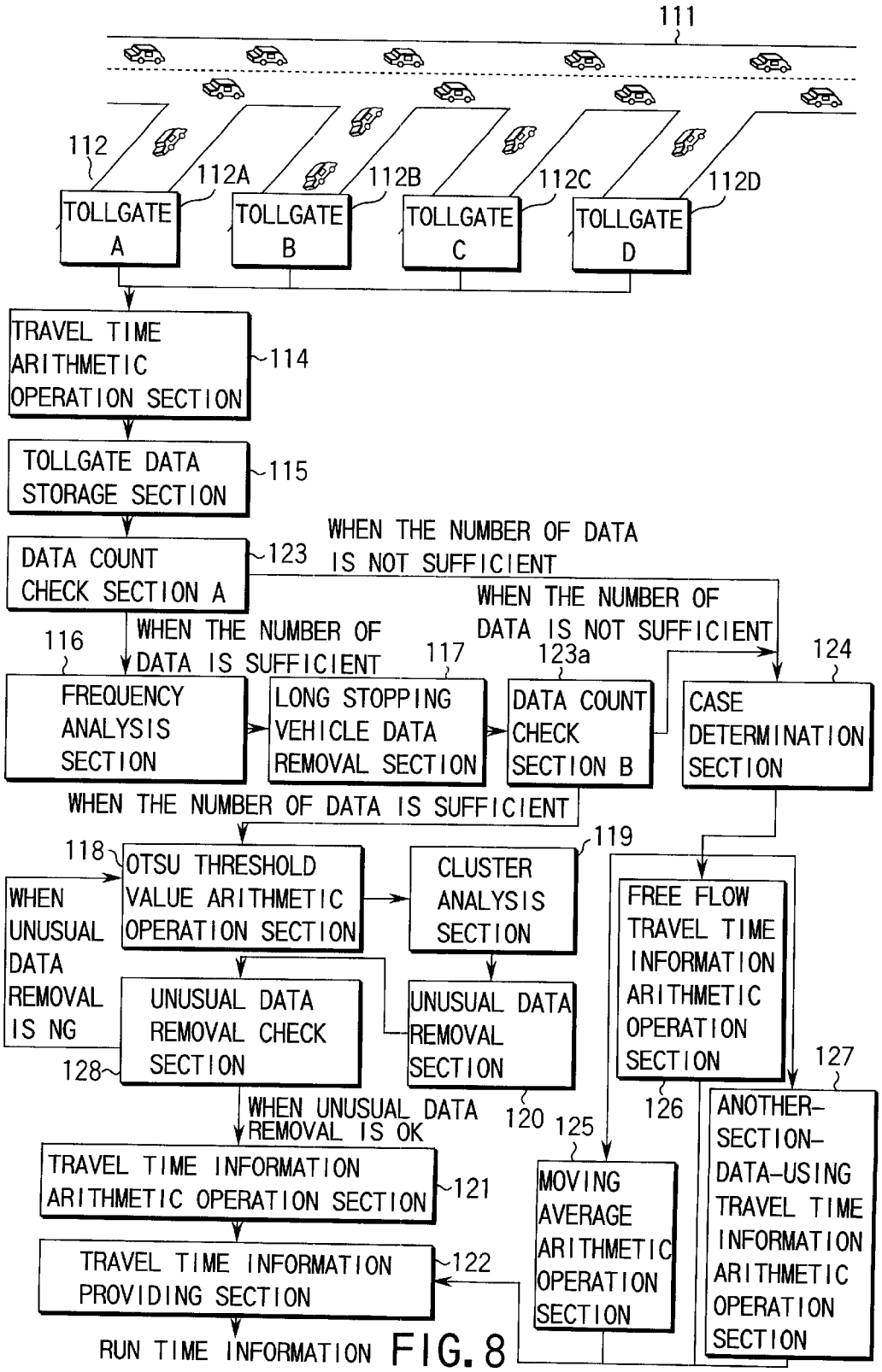
FIG. 8 is a block diagram of a travel time information arithmetic operation apparatus according to the seventh embodiment of the present invention.

The seventh embodiment will be described with reference to FIG. 8.

In this third embodiment as well, assume that a toll collection system is installed in an object route. The system comprises a tollroad 111, tollgates 112, travel time arithmetic operation section 114, tollgate data storage section 115, frequency analysis section 116, long-stopping-vehicle data removal section 117, Otsu threshold value arithmetic operation section 118, cluster analysis section 119, unusual data removal section 120, travel time information arithmetic operation section 121, travel time information providing section 122, data count check section 123, case determination section 124, moving average arithmetic operation section 125, free-flow-travel time information arithmetic operation section 126, and another-section-data-using-travel time information arithmetic operation section 127.

The function of the seventh embodiment will be described next.

First, tollgate data representing the entry tollgate pass time, exit tollgate pass time, kind of vehicle, and whether the dates are consecutive is acquired from the tollgate 112 installed on the tollroad, and on the basis of this data, the travel time arithmetic operation section 114 calculates the travel time. The travel time is obtained from the entry tollgate pass time and exit tollgate pass time. For example, the travel time is calculated as follows.

Run time=exit tollgate pass time−entry tollgate pass time

If dates are consecutive, it is taken into consideration. Next, the travel time calculated by the travel time arithmetic operation section 114 and tollgate data obtained from the tollgate 112 are stored as a file or the like in the tollgate data storage section 115.

Next, a data count check section (A) 123*a* checks whether data in number necessary (e.g., x) for travel time calculation are stored in the tollgate data storage section 115. If the data count check section (A) 123*a* checks and determines that the number of data is insufficient, the case determination section 124 determines whether the moving average, free-flow-travel time information, or travel time information using data of another section is appropriate as travel time information. Examples of a rule used for this determination are as follows.

(a) Free flow travel time information is used for a route with light traffic.

(b) The moving average is used at night.

(c) Run time information using data of another section is used for a section of an ordinary used route, where traffic is light.

When the case determination section 124 selects the moving average, the moving average arithmetic operation section 125 calculates the moving average, and the result is used as travel time information.

When the case determination section 124 selects free-flow-travel time information, the tollgate data storage section 115 calculates travel time for free flow travel, and the result is used as travel time information. The simplest method of calculating the travel time for free flow travel is a method of dividing the route length by the free flow average speed.

When the case determination section 124 selects travel time information using data of another section, the another-section-data-using-travel time information arithmetic operation section 127 calculates travel time information by subtracting travel time data of another section from that of the self-section, and the result is used as travel time information.

If the data count check section (A) 123*a* determines that the number of data is sufficient, the frequency analysis section 116 analyzes the frequency distribution of data stored every n minutes on the basis of the travel time data stored in the tollgate data storage section 115. In frequency distribution analysis, the frequency of travel time n-minutes accumulated data is analyzed by dividing the travel time into levels of m minutes and counting the frequency of each level. For example, the number of data corresponding to each level every five minutes (e.g.., 0 to 5 minutes, 5 to 10 minutes, 10 to 15 minutes) of travel time is counted in travel time data stored every five minutes from 0:00 to 0:05.

Next, on the basis of the frequency analysis result from the frequency analysis section 116, the long-stopping-vehicle data removal section 117 removes long-stopping-vehicle data,. Long-stopping-vehicle data means a vehicle that is stopping for a long time mainly in a service area or a rest area. In the frequency distribution (FIG. 9A), the long stopping vehicle data corresponds to data with an extremely long travel time. As a removal rule for long-stopping-vehicle data, the following rules can be used.

When the travel time level is set in ascending order of travel time, all travel times after level of frequency "0" continues p times are regarded as long stopping vehicle data. For example, when level of frequency "0" continues for five levels, data after that is regarded as long stopping vehicle data. In this case, in the graph shown in FIG. 9B, data in a range A is regarded as long-stopping-vehicle data.

After the long-stopping-vehicle data removal section 117 removes the long-stopping-vehicle data, a data count check section (B) 123*b* checks the number of data again. The check method is the same as that of the data count check section (A) 123*a*. If the data count check section (B) 123*b* determines that the number of data is insufficient, the case determination section 124 determines the case, and the moving average, free-flow-travel time information, or travel time information using data of another section is generated and used as travel time information (the series of functions are the same as described above).

If the data count check section (B) 123*b* determines that the number of data is sufficient, the Otsu threshold value arithmetic operation section 118 calculates the Otsu threshold value for data after removal of long-stopping-vehicle data. The Otsu threshold value is obtained by the above-described calculation method.

On the basis of the Otsu threshold value calculated by the otsu threshold value arithmetic operation section 118, the cluster analysis section 119 divides the travel time data into two sets. By this division, the travel time data is divided into a set of data larger than the Otsu threshold value and a set of data smaller than the threshold value. On the basis of the two sets divided by the cluster analysis section 119, the unusual data removal section 120 removes unusual data. For the two sets divided, unusual data is removed using the following rules.

(I) Of the sets generated by division on the basis of the Otsu threshold value, data in a smaller number are regarded as unusual data and removed.

(II) Of the sets generated by division on the basis of the Otsu threshold value, data with longer travel times are regarded as unusual data and removed.

Figures 9A, 9B:
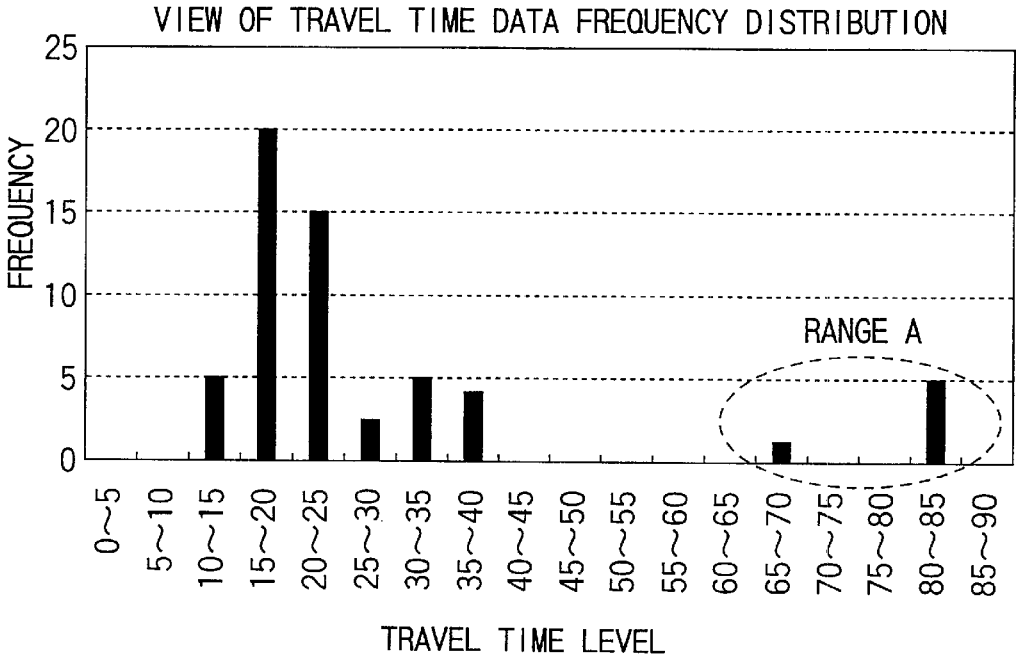
FIGS. 9A and 9B are views showing a travel time data frequency distribution for deleting long stopping vehicle data.
Figure 10:
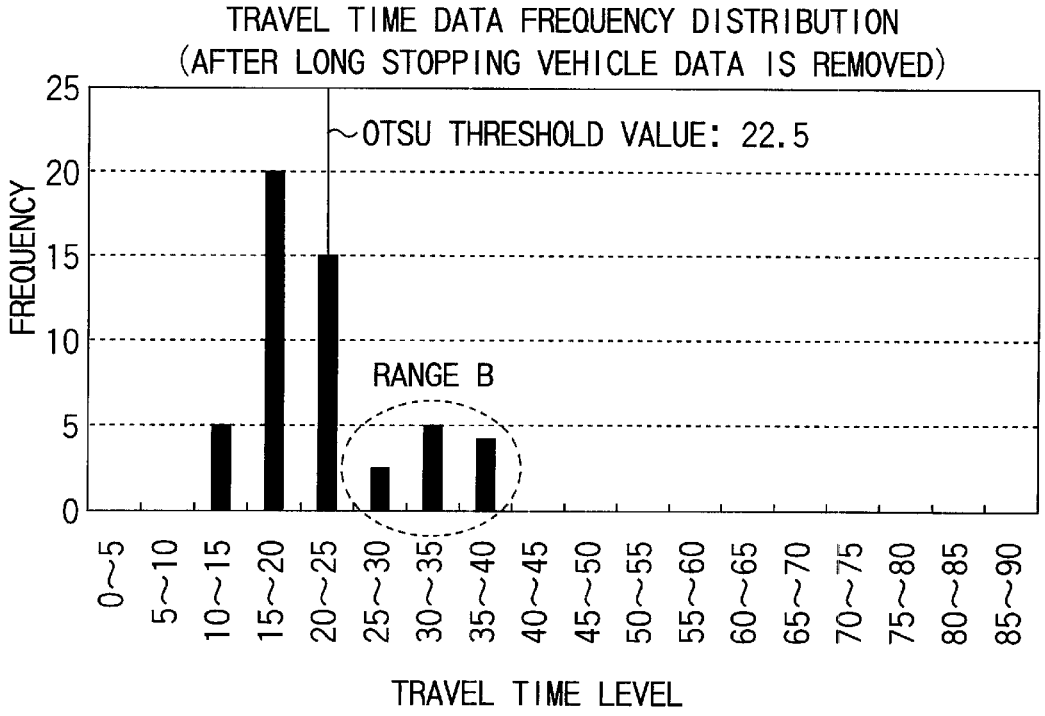
FIG. 10 is a view showing a travel time data frequency distribution upon deleting unusual data according to the Otsu threshold method.

When unusual data are removed using the rule (II) in the examples shown in FIGS. 9A and 9B, data in a range B shown in FIG. 10 are removed as unusual data. Using travel time data after the unusual data removal section 120 removes the unusual data, the travel time information arithmetic operation section 121 calculates travel time information. In this case, the simplest travel time information is the average of the travel time data.

Finally, the result calculated by the travel time information arithmetic operation section 121, moving average arithmetic operation section 125, free-flow-travel time information arithmetic operation section 126, or another-section-data-using-travel time information arithmetic operation section 127 is provided by the travel time information providing section 122 as travel time information.

As described above, according to the travel time information arithmetic operation apparatus of the seventh embodiment, travel time information is calculated after unusual data (including long stopping vehicle data) are removed from tollgate data. Hence, travel time information having a high value in use can be calculated while removing the influence of data of vehicles which are stopping for a long time in a service area or a rest area and vehicles traveling in a manner different from the general traveling method (e.g., when the driver likes to drive at an extremely high speed or low speed). Especially, since the Otsu threshold method capable of always determining the threshold value is used in removing unusual data, unusual data can be removed to some extent even when determination of unusual data is ambiguous. This arrangement can also cope with a case wherein the number of data is small. For this reason, degradation in accuracy due to the small number of data can be avoided.

In the seventh embodiment, the data count check section checks the number of data, and the travel time information calculation method is selectively used depending on whether the number of data is sufficient or insufficient. If the provided information update interval is large, the disadvantage of a shortage in number of data can be reduced by storing data in a time corresponding to the update interval. When an ETC (Electronic Toll Collection) system is used as the toll collection system, this method can also be used for a route having an ETC. When an object route is constructed by a plurality of sections (one section is set from a certain tollgate to the next tollgate), the travel time information of the object route can be calculated by, e.g., totalizing pieces of travel time information in the respective sections, which are calculated by the travel time information arithmetic operation apparatus of the present invention. In this case, each section has the influence of acceleration/deceleration in passing through the tollgate, and this must be taken into consideration (for example, the travel time information of each section after delete of tollgate pass time is used). This method can also be applied to a plurality of routes whose object roads are managed by a plurality of systems.

Figure 11:
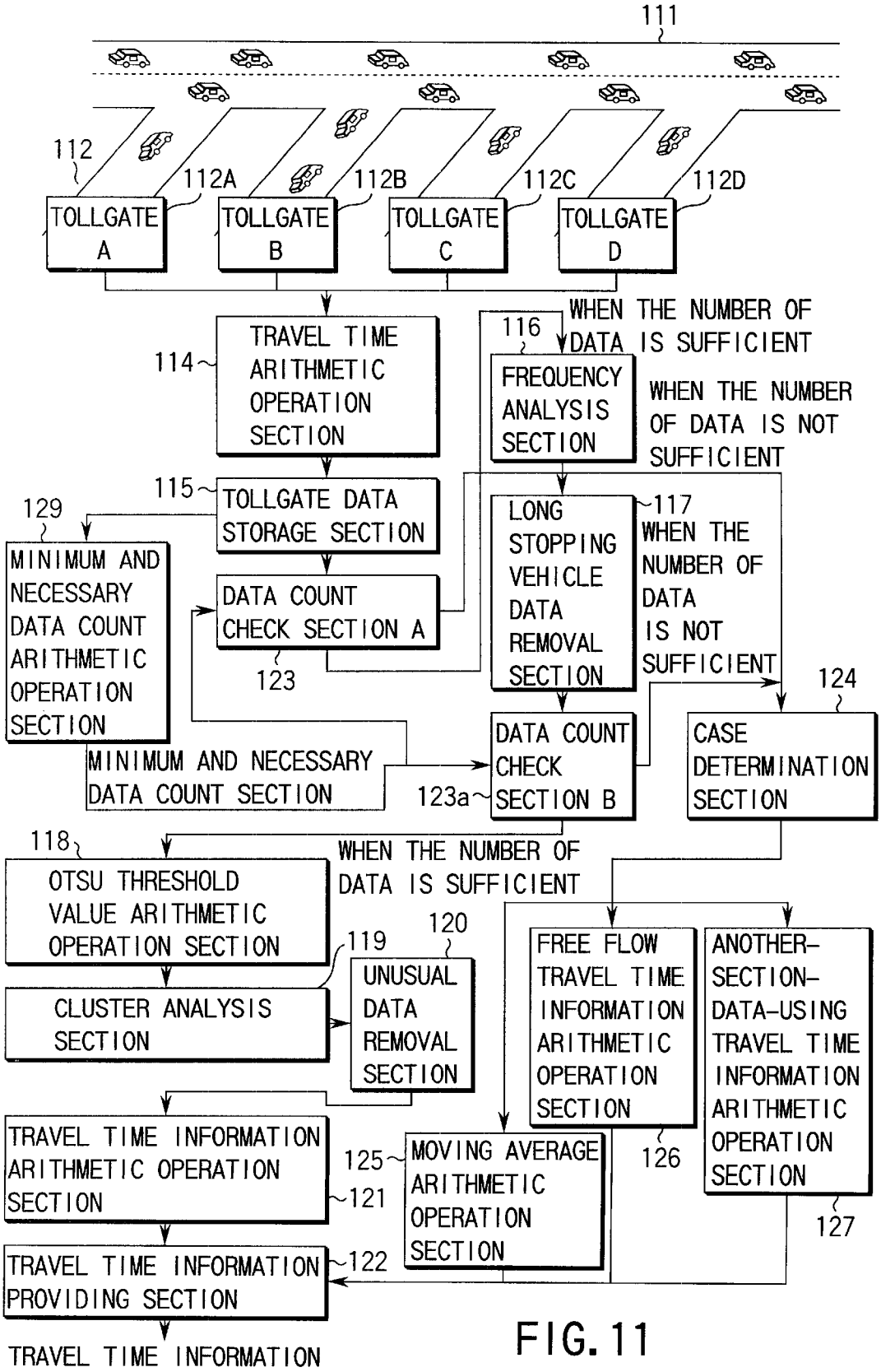
FIG. 11 is a block diagram of a travel time information arithmetic operation apparatus according to the eighth embodiment of the present invention.

The eighth embodiment of the present invention will be described next with reference to FIG. 11. In this embodiment, in addition to the function of the sixth embodiment, the minimum and necessary data count used by a data count check section 123*a* is calculated by a minimum and necessary data count arithmetic operation section 129 on the basis of travel time data in consideration of the confidence interval in estimating the interval of the average value. A method of determining the minimum and necessary data count from the confidence interval as a reference for of necessary data count.

Assume that a certain data set has normal distribution, and population variance σ2 is known. In this case, the confidence interval of a true average value $\mu$ of the population set for a significance level α is represented as follows (x is the sample mean, and $z_{a/2}$ represents that the area on the right side of standard normal distribution has a value equal to α/2).

$$\left[\bar{x} - z_{\frac{a}{2}}\frac{\sigma}{\sqrt{n}}, \bar{x} + z_{\frac{a}{2}}\frac{\sigma}{\sqrt{n}}\right]$$

Since the sample mean x falls within the range of ε from the true average value $\mu$, a necessary data count n is obtained as follows.

$$z_{\frac{\alpha}{2}}\frac{\sigma}{\sqrt{n}} < \varepsilon \rightarrow n \geq \frac{z_{\frac{\alpha}{2}}^2\sigma^2}{\varepsilon^2}$$

Hence, when variance is 81, standard deviation is 9, the degree of confidence is 95% (significance level 0.05), and ε=5, the necessary data count is obtained as follows. $z_{a/2}$ is obtained from the percentile table of normal distribution or percentile table of t distribution.

$$n \geq \frac{z_{\frac{\alpha}{2}}^2\sigma^2}{\varepsilon^2} = \frac{z_{0.025}^2 \times 81}{25} = \frac{1.96^2 \times 81}{25} = 12$$

(For details, see the following references).

1) Society of Transportation Engineering, "Handbook of Transportation Engineering", Gihodo Shuppan
2) Freund, "Fundamentals of Modern Statistics 2", translated by Kanzo Hino, Tokyo Tosho
3) Masayasu Murakami, Masahiro Yasuda, "Seminor in Statistics", Baifukan Hence, in this case, the minimum and necessary data count is 12. In the invention of the eighth embodiment, a data count check section (A) 123*a* and data count check section (B) 123*b* check the number of data using this minimum and necessary data count.

As a modification to the fifth embodiment, a function of using data obtained by deleting, by the frequency analysis section, data of motorcycles from n-minutes accumulated data stored in the tollgate data storage section is added. As the simplest method, data of a motorcycle can be determined from kind-of-vehicle data, which is obtained as the tollgate data, and deleted.

As a modification to the sixth embodiment, a function of checking by the data count check section (A) 123*a* whether data obtained by deleting data of motorcycles from n-minutes accumulated data stored in the tollgate data storage section satisfies the necessary data count is added. As the simplest method, data of a motorcycle can be determined from kind-of-vehicle data, which is obtained as the tollgate data, and deleted.

As a modification to the seventh embodiment, a function of checking by the data count check section (A) 123*a* whether data obtained by deleting data of motorcycles from n-minutes accumulated data stored in the tollgate data storage section 115 satisfies the necessary data count is added. As the simplest method, data of a motorcycle can be determined from kind-of-vehicle data, which is obtained in the tollgate data storage section 115, and deleted.

As a modification to the eighth embodiment, a function of checking by the data count check section (A) 123*a* whether data obtained by deleting data of motorcycles from n-minutes accumulated data stored in the tollgate data storage section 115 satisfies the necessary data count is added. As the simplest method, data of a motorcycle can be determined from kind-of-vehicle data, which is obtained as the tollgate data, and deleted.

According to the present invention, even in a route without any sensors such as vehicle detectors, travel time information can be calculated at low cost as far as the road is a tollroad having a toll collection system.

According to the present invention, the influence of data of vehicles which are stopping for a long time in a service area or a rest area and vehicles traveling in a manner different from the general traveling method is removed, so travel time information having a high value in use can be calculated.

According to the present invention, the apparatus can also cope with a case wherein the number of data is small, and degradation in accuracy due to the small number of data can be avoided.

According to the present invention, the latest current information can be provided at the entry tollgate as travel time information obtained at the exit tollgate.

According to the present invention, when data obtained by rearranging tollgate data in units of entry tollgates is used, use of data along with the elapse of time at the entry tollgate is enabled. Hence, travel time information according to the change over time at the entry tollgate can be provided, and a travel time having a high value in use can be provided at the entry tollgate.

According to the present invention, travel time information for traveling on a plurality of routes can be calculated.

According to the present invention, since data of motorbikes are deleted in advance, more accurate travel time information without any influence of data with extremely short travel time can be calculated.

According to the present invention, since unusual data (including long-stopping-vehicle data) are deleted from tollgate data, and travel time information is calculated, travel time information having a high value in use can be calculated while removing the influence of data of vehicles which are stopping for a long time in a service area or a rest area and vehicles traveling in a manner different from the general traveling method (e.g., when the driver likes to drive at an extremely high speed or low speed). Especially, since the Otsu threshold method capable of always determining the threshold value is used in removing unusual data, unusual data can be removed to some extent even when determination of unusual data is ambiguous.

Since the data count check section is provided, the apparatus can cope with a case wherein the number of data is small, and degradation in accuracy due to the small number of data can be avoided.

Since the unusual data removal section is provided, unusual data can be repeatedly removed, and more accurate travel time information can be calculated.

Since the minimum and necessary data count arithmetic operation section is provided, check using a theoretical necessary data count is enabled by statistically obtaining the minimum and necessary data count for calculation of travel time information, and the apparatus can more accurately cope with a case wherein the number of data is small.

Since the function of removing data of motorcycles is provided, extremely short travel time data in case of, e.g., traffic jam can be deleted, and more accurate travel time information can be calculated.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A vehicle travel time calculation apparatus for calculating a vehicle travel time in association with a toll collection system installed on a tollroad, comprising:

a first calculation section configured to calculate a travel time of each of a plurality of vehicles on the basis of toll station data obtained by said toll collection system and representing an entry point, entry time, exit point, exit time, model of the vehicle, and date, and output travel time data corresponding to travel times of the plurality of vehicles;

a storage section configured to store the toll station data obtained by said toll collection system and the travel time data obtained by said first calculation section; and a second calculation section configured to calculate an average travel time of the vehicles using the travel time data stored in said storage section at given intervals of minutes, and generating travel time information, said second calculation section calculating the travel time information on the basis of data associated with a kind of vehicle using data obtained by deleting data associated with at least one motorbike.

2. An apparatus according to claim 1, wherein said second calculation section comprises an unusual data removal section configured to remove, from the data stored in said storage section, unusual data corresponding to data not more than a standard deviation of a travel time data distribution which is defined as a reference, and the average travel time is calculated using travel time data accumulated during n-minutes after unusual data is removed by said unusual data removal section.

3. An apparatus according to claim 2, wherein said second calculation section comprises a check section configured to check, using data obtained by removing the unusual data by said unusual data removal section, whether data in number necessary for travel time calculation are obtained, and a third calculation section configured to calculate a travel time in no traffic jam when said check section determines that the data in number necessary for travel time calculation are not present, and a fourth calculation section configured to calculate the average travel time using the travel time n-minutes accumulated data when said check section determines that the data in number necessary for travel time calculation are present.

4. An apparatus according to claim 3, further including a section configured to provide travel time information calculated using data collected in units of exit tollgates to an entry tollgate.

5. An apparatus according to claim 1, further comprising a section configured to provide, to an entry tollgate, travel time information calculated using data collected in units of exit tollgates.

6. An apparatus according to claim 1, further comprising a section configured to provide, to an entry tollgate, travel time information calculated using data obtained by rearranging, in units of entry tollgates, data collected in units of exit tollgates.

7. An apparatus according to claim 2, further including a section configured to provide travel time information calculated using data collected in units of exit tollgates to an entry tollgate.

8. An apparatus according to claim 2, further comprising a section configured to provide, to an entry tollgate, travel time information calculated using data obtained by rearranging, in units of entry tollgates, data collected in units of exit tollgates.

9. An apparatus according to claim 2, wherein said second calculation section calculates the travel time information on the basis of data associated with a kind of vehicle using data obtained by deleting data associated with a motorbike.

10. A travel time information arithmetic operation apparatus according to claim 2, wherein said first data count check section checks whether the necessary data count is satisfied by data obtained by deleting data of a motorcycle from the n-minutes accumulated data stored in said tollgate data storage section.

11. An apparatus according to claim 3, further comprising a section configured to provide, to an entry tollgate, travel time information calculated using data obtained by rearranging, in units of entry tollgates, data collected in units of exit tollgates.

12. An apparatus according to clam 3, wherein said second calculation section includes a plurality of calculators which are installed in plurality of continuous routes, respectively, and calculate a travel time for traveling through the plurality of routes on the basis of travel time information calculated in the respective routes.

13. An apparatus according to claim 3, wherein said second calculation section calculates the travel time information on the basis of data associated with a kind of vehicle using data obtained by deleting data associated with a motorbike.

14. A vehicle travel time calculation apparatus for calculating vehicle travel time in association with a toll collection system installed on a tollroad, comprising:

a first calculation section configured to calculate a travel time of each of a plurality of vehicles on the basis of toll station data obtained by said toll collection system and representing an entry time, exit time, model of the vehicle, and date, and output travel time data corresponding to the plurality of vehicles;

a storage section configured to store the toll station data and the travel time data;

a frequency analysis section configured to analyze a frequency of the time travel data stored in said storage section at given intervals of minutes;

a first data removal section configured to remove long-stopping-vehicle data from a result of frequency analysis by said frequency analysis section;

an Otsu threshold value arithmetic operation section configured to calculate, using an Otsu threshold method, an Otsu threshold value used to divide, into a plurality of divisions, the data of predetermined minutes after the long-stopping-vehicle data is removed;

a cluster analysis section configured to divide the predetermined-minutes accumulated data into a plurality of divisions using the threshold value calculated by said Otsu threshold value arithmetic operation section;

a second data removal section configured to remove unusual data from the divisions on the basis of a result from said cluster analysis section; and a second calculation section configured to calculate an average travel time of the vehicles on the basis of the travel time data stored in said storage section at given intervals of minutes after the unusual data is removed by said second data removal section and to generate travel time information.

15. A vehicle travel time calculation apparatus for calculating a vehicle travel time in association with a toll collection system installed on a tollroad, comprising:

a first calculation section configured to calculate a travel time of each of a plurality of vehicles on the basis of toll station data obtained by said toll collection system and representing an entry time, exit time, model of the vehicle, and date, and output travel time data corresponding to travel times of the plurality of vehicles;

a storage section configured to store the toll station data and the travel time data;

a frequency analysis section configured to analyze a frequency of the travel time data stored in said storage section at given intervals of minutes;

a first data removal section configured to remove long-stopping-vehicle data from a result of frequency analysis by said frequency analysis section;

an Otsu threshold value arithmetic operation section configured to calculate, using an Otsu threshold method, a threshold value used to divide, into two divisions, the travel time data stored in the storage section at intervals of n-minutes after the long-stopping-vehicle data is removed by said first data removal section;

a cluster analysis section configured to divide the n-minutes accumulated data into two divisions using the threshold value calculated by said Otsu threshold value arithmetic operation section;

a second data removal section configured to remove unusual data from the two divisions on the basis of a result from said cluster analysis section;

a second calculation section configured to calculate an average travel time of the vehicles using the time travel data stored in the storage section at intervals of n-minutes after the unusual data is removed by said second data removal section; and a travel time information providing section for providing the travel time information calculated by said travel time information arithmetic operation section.

16. A travel time information arithmetic operation apparatus according to claim 15, wherein said frequency analysis section analyses the frequency using data obtained by deleting data of a motorcycle from the n-minutes accumulated data stored in said tollgate data storage section.

17. A travel time information arithmetic operation apparatus using data including an entry point, entry time, exit point, and exit time, which is obtained by a toll collection system installed on a tollroad, characterized by comprising:

a travel time arithmetic operation section for calculating a travel time of a predetermined section on the basis of data associated with an entry tollgate pass time, exit tollgate pass time, kind of vehicle, and date, which is obtained by said toll collection system;

a tollgate data storage section for storing the data obtained by said toll collection system and travel time data obtained by said travel time arithmetic operation section;

a first data count check section for checking whether a necessary data count is satisfied by n-minutes accumulated data stored in said tollgate data storage section;

a moving average arithmetic operation section for obtaining travel time information using a moving average as one travel time information arithmetic operation method when the number of data is small;

a free-flow-travel time information arithmetic operation section for obtaining travel time information using a travel time in no traffic jam as one travel time information arithmetic operation method when the number of data is small;

an another-section-data-using-travel time information arithmetic operation section for obtaining travel time information by subtracting data of another section as one travel time information arithmetic operation method when the number of data is small;

a case determination section for, when said first data count check section determines that the data count is not satisfied, determining, as a travel time information arithmetic operation section to be used when the number of data is small, one of said moving average arithmetic operation section, said free-flow-travel time information arithmetic operation section, and said another-section-data-using-travel time information arithmetic operation section;

a frequency analysis section for, when said first data count check section determines that the data count is satisfied, analyzing a frequency of the n-minutes accumulated data stored in said tollgate data storage section;

a long-stopping-vehicle data removal section for removing long-stopping-vehicle data from a result of frequency analysis by said frequency analysis section;

a second data count check section for checking the data count after the long-stopping-vehicle data is removed;

an Otsu threshold value arithmetic operation section for, when said second data count check section determines that the data count is satisfied, using the Otsu threshold method, calculating a threshold value used to divide, into two divisions, the n-minutes accumulated data after the long-stopping-vehicle data is removed by said long-stopping-vehicle data removal section;

a cluster analysis section for dividing the n-minutes accumulated data into two divisions using the threshold value calculated by said Otsu threshold value arithmetic operation section;

a unusual data removal section for removing unusual data on the basis of a result from said cluster analysis section;

a travel time information arithmetic operation section for calculating an average travel time value as travel time information using the n-minutes accumulated data after the unusual data is removed by said unusual data removal section; and a travel time information providing section for providing the travel time information calculated by said travel time information arithmetic operation section.

18. A travel time information arithmetic operation apparatus according to claim 17, wherein said apparatus further comprises a unusual data removal check section for checking whether the unusual data removal result is appropriate using the data obtained by removing the unusual data by said unusual data removal section, and when it is determined on the basis of a result from said unusual data removal check section that unusual data removal is not appropriate, unusual data is removed by said Otsu threshold value arithmetic operation section, said cluster analysis section, and said unusual data removal section again.

19. A travel time information arithmetic operation apparatus according to claim 18, wherein said first data count check section checks whether the necessary data count is satisfied by data obtained by deleting data of a motorcycle from the n-minutes accumulated data stored in said tollgate data storage section.

20. A travel time information arithmetic operation apparatus according to claim 17, wherein said data count check section determines a minimum and necessary data count on the basis of a confidence interval in estimating an interval of an average value and checks the data count.

21. A travel time information arithmetic operation apparatus according to claim 20, wherein said first data count check section checks whether the necessary data count is satisfied by data obtained by deleting data of a motorcycle from the n-minutes accumulated data stored in said tollgate data storage section.

22. A travel time information arithmetic operation apparatus using data obtained by a toll collection system installed on a tollroad, comprising:

a travel time arithmetic operation section for calculating a travel time of a vehicle on the basis of data obtained by said toll collection system and representing an entry point, entry time, exit point, exit time, and model of the vehicle, and date;

a tollgate data storage section for storing the data obtained by said toll collection system and travel time data obtained by said travel time arithmetic operation section; and a travel time information arithmetic operation section for calculating a travel time average using the travel time data of predetermined minutes stored in said tollgate data storage section, and generating travel time information, and for calculating the travel time information on the basis of data associated with a kind of vehicle using data obtained by deleting data associated with a motorbike.

23. A travel time information arithmetic operation apparatus using data obtained by a toll collection system installed on a tollroad, comprising:

a travel time arithmetic operation section for calculating a travel time of a vehicle on the basis of data obtained by said toll collection system and representing an entry point, entry time, exit point, exit time, and model of the vehicle, and date;

a tollgate data storage section for storing the data obtained by said toll collection system and travel time data obtained by said travel time arithmetic operation section; and a travel time information arithmetic operation section for calculating a travel time average using the travel time data of predetermined minutes stored in said tollgate data storage section and for calculating the travel time information on the basis of data associated with a kind of vehicle using data obtained by deleting data associated with a motorbike, comprising:

an unusual data removal section for removing, from the data stored in said tollgate data storage section, unusual data corresponding to data not more than a standard deviation of a travel time data distribution which is defined as a reference, and the travel time average time is calculated using travel time n-minutes accumulated data after unusual data is removed by said unusual data removal section.

24. A travel time information arithmetic operation apparatus using data obtained by a toll collection system installed on a tollroad, comprising:

a travel time arithmetic operation section for calculating a travel time of a vehicle on the basis of data obtained by said toll collection system and representing an entry point, entry time, exit point, exit time, and model of the vehicle, and date;

a tollgate data storage section for storing the data obtained by said toll collection system and travel time data obtained by said travel time arithmetic operation section; and a travel time information arithmetic operation section for calculating a travel time average using the travel time data of predetermined minutes stored in said tollgate data storage section, and for generating travel time information, comprising:

an unusual data removal section for removing, from the data stored in said tollgate data storage section, unusual data corresponding to data not more than a standard deviation of a travel time data distribution which is defined as a reference, and the travel time average time is calculated using travel time n-minutes accumulated data after unusual data is removed by said unusual data removal section, a necessary data count check section for checking, using data obtained by removing the unusual data by said unusual data removal section, whether data in number necessary for travel time calculation are obtained, a small-number-of-data travel time information arithmetic operation section, for calculating travel time information in no traffic jam when said necessary data count check section determines that the data in number necessary for travel time calculation are not present; and said travel time information arithmetic operation section for calculating the average travel time value using the travel time n-minutes accumulated data when said necessary data count check section determines that the data in number necessary for travel time calculation are present, and for calculating the travel time information on the basis of data associated with a kind of vehicle using data obtained by deleting data associated with a motorbike.

25. A travel time information arithmetic operation apparatus using data obtained by a toll collection system installed on a tollroad, comprising:

a travel time arithmetic operation section for calculating a travel time of a vehicle on the basis of data obtained by said toll collection system and representing an entry time, exit time, model of the vehicle, and date;

a tollgate data storage section for storing the data obtained by said toll collection system and travel time data obtained by said travel time arithmetic operation section;

a frequency analysis section for analyzing a frequency of n-minutes accumulated data stored in said tollgate data storage section;

a long-stopping-vehicle data removal section for removing long-stopping-vehicle data from a result of frequency analysis by said frequency analysis section;

an Otsu threshold value arithmetic operation section for, using the Otsu threshold method, calculating threshold value used to divide, into two divisions, the n-minutes accumulated data after the long-stopping-vehicle data is removed by said long-stopping-vehicle data removal section;

a cluster analysis section for dividing the n-minutes accumulated data into two divisions using the threshold value calculated by said Otsu threshold value arithmetic operation section;

a unusual data removal section for removing unusual data on the basis of a result from said cluster analysis section;

a travel time information arithmetic operation section for calculating an average travel time value as travel time information using the n-minutes accumulated data after the unusual data is removed by said unusual data removal section; and said travel time information providing section for providing the travel time information calculated by said travel time information arithmetic operation section, wherein:

a frequency analysis section analyzes the frequency using data obtained by deleting data of a motorcycle from the n-minutes accumulated data stored in said tollgate data storage section.

26. A travel time information arithmetic operation apparatus using data obtained by a toll collection system installed on a tollroad, comprising:

a travel time arithmetic operation section for calculating a travel time of a vehicle on the basis of data obtained by said toll collection system and representing an entry point, entry time, exit point, exit time, and model of the vehicle, and date;

a tollgate data storage section for storing the data obtained by said toll collection system and travel time data obtained by said travel time arithmetic operation section; and said travel time information arithmetic operation section for calculating a travel time average using the travel time data of predetermined minutes stored in said tollgate data storage section, and generating travel time information, comprising an unusual data removal section for removing, from the data stored in said tollgate data storage section, unusual data corresponding to data not more than a standard deviation of a travel time data distribution which is defined as a reference, and the travel time average time is calculated using travel time n-minutes accumulated data after unusual data is removed by said unusual data removal section; and a first data count check section checking whether the necessary data count is satisfied by data obtained by deleting data of a motorcycle from the n-minutes accumulated data stored in said tollgate data storage section.

* * * * *